US009089190B2

(12) United States Patent
Booker

(10) Patent No.: US 9,089,190 B2
(45) Date of Patent: Jul. 28, 2015

(54) DIABETIC DISPENSER

(75) Inventor: Adam Jay Booker, Herts (GB)

(73) Assignee: NRGBAND LIMITED, Thames Ditton (GB)

( * ) Notice: Subject to any disclaimer, the term of this patent is extended or adjusted under 35 U.S.C. 154(b) by 1422 days.

(21) Appl. No.: 12/161,411

(22) PCT Filed: Jan. 19, 2007

(86) PCT No.: PCT/GB2007/000169

§ 371 (c)(1),
(2), (4) Date: Jun. 9, 2010

(87) PCT Pub. No.: WO2007/083135

PCT Pub. Date: Jul. 26, 2007

(65) Prior Publication Data

US 2010/0237115 A1 Sep. 23, 2010

(30) Foreign Application Priority Data

Jan. 19, 2006 (GB) ..... 0601086.2

(51) Int. Cl.
*A45F 3/16* (2006.01)
*A45F 5/00* (2006.01)
(Continued)

(52) U.S. Cl.
CPC ..... *A44C 5/003* (2013.01); *A44C 5/0023* (2013.01); *A61J 1/035* (2013.01); *A45F 2005/008* (2013.01)

(58) Field of Classification Search
CPC . A44C 5/0023; A61J 1/035; A45F 2005/008; A45F 3/20; A45C 1/04; A45D 34/00
USPC ..... 224/148.1–148.3, 148.7, 217–219, 221
See application file for complete search history.

(56) References Cited

U.S. PATENT DOCUMENTS 2,235,350 A * 3/1941 Anderson ..... 224/148.7
2,270,216 A 1/1942 Marwil
(Continued)

FOREIGN PATENT DOCUMENTS

FR 2655523 A1 6/1991
WO WO9948405 9/1999
(Continued)

OTHER PUBLICATIONS

International Search Report and Written Opinion from related PCT/GB2007/000169, mailed Jun. 27, 2007.
(Continued)

*Primary Examiner* — Justin Larson
*Assistant Examiner* — Peter Helvey
(74) *Attorney, Agent, or Firm* — Procopio, Cory, Hargreaves & Savitch LLP

(57) ABSTRACT

A dispenser bracelet wearable on the wrist or arm and for carrying a consumable product for the treatment of the symptoms of hypoglycemia of a diabetic user, the dispenser bracelet comprising: a bracelet body (41) having one or more sealed receptacles (42) for containing said consumable product; one or more access portions (43) provided on a surface of the bracelet body and through which access to the consumable product; and a bite area associated with each of the one or more access portions having a frangible seal for sealing said teats, said seal being frangible by the user biting the bite area for allowing the consumable product to be readily accessed through the one or more access portions by the user's mouth.

13 Claims, 9 Drawing Sheets

(51) Int. Cl.

| | |
|---|---|
| ***A44C 5/00*** | (2006.01) |
| ***A61J 1/03*** | (2006.01) |

(56) References Cited

U.S. PATENT DOCUMENTS

| | | | | | |
|---|---|---|---|---|---|
| 2,342,372 | A | * | 2/1944 | Scherer | 222/541.1 |
| D138,099 | S | | 6/1944 | Peyrot | |
| 2,473,226 | A | * | 6/1949 | Sheldon | 224/219 |
| 2,954,622 | A | | 10/1960 | Moore | |
| 3,009,614 | A | * | 11/1961 | Humphner | 224/219 |
| 3,402,808 | A | * | 9/1968 | Yannuzzi | 206/232 |
| 3,680,751 | A | * | 8/1972 | Ten Brook | 224/219 |
| 3,924,304 | A | * | 12/1975 | Grandmont | 24/163 K |
| 4,078,660 | A | * | 3/1978 | Lerro | 206/530 |
| 4,199,882 | A | * | 4/1980 | Clayman | 40/633 |
| D259,220 | S | * | 5/1981 | Small et al. | D3/221 |
| 4,462,116 | A | * | 7/1984 | Sanzone et al. | 2/170 |
| 4,483,626 | A | * | 11/1984 | Noble | 368/10 |
| 4,736,876 | A | * | 4/1988 | Kriss | 224/148.1 |
| 4,768,688 | A | * | 9/1988 | Harrigan | 224/148.2 |
| D298,217 | S | | 10/1988 | Pavlovic | |
| D299,811 | S | | 2/1989 | Tsukui | |
| 4,932,566 | A | * | 6/1990 | Weinbaum | 222/175 |
| 4,988,097 | A | * | 1/1991 | Smith et al. | 482/105 |
| D315,245 | S | * | 3/1991 | Envall | D3/202 |
| 5,072,935 | A | * | 12/1991 | McWain | 482/105 |
| D323,430 | S | * | 1/1992 | Niederkorn | D3/202 |
| D335,447 | S | | 5/1993 | Boivin | |
| 5,282,557 | A | * | 2/1994 | McCook | 224/148.2 |
| 5,305,470 | A | * | 4/1994 | McKay | 2/7 |
| 5,476,194 | A | * | 12/1995 | Hippely et al. | 222/192 |
| 5,566,869 | A | * | 10/1996 | Katz | 224/148.6 |
| 5,669,529 | A | * | 9/1997 | Levit | 222/78 |
| 5,671,481 | A | * | 9/1997 | Giard | 2/170 |
| 5,802,014 | A | * | 9/1998 | Danko | 368/10 |
| D408,988 | S | * | 5/1999 | Barber et al. | D3/215 |
| 5,938,089 | A | | 8/1999 | Abreu-Marston | |
| 5,957,347 | A | * | 9/1999 | White et al. | 224/148.1 |
| 6,056,729 | A | * | 5/2000 | Yu et al. | 604/289 |
| 6,126,041 | A | * | 10/2000 | DiTomasso et al. | 222/95 |
| 6,173,866 | B1 | * | 1/2001 | Taylor et al. | 222/175 |
| 6,340,242 | B1 | * | 1/2002 | Sandidge | 368/278 |
| 6,349,414 | B1 | * | 2/2002 | Tillman | 2/170 |
| 6,464,389 | B1 | * | 10/2002 | Ghoorahoo | 368/278 |
| 6,516,981 | B2 | * | 2/2003 | Perez et al. | 224/148.6 |
| 6,574,165 | B2 | * | 6/2003 | Sharma et al. | 368/10 |
| 6,581,811 | B1 | | 6/2003 | Schillaci | |
| 6,772,445 | B2 | * | 8/2004 | Yeager | 2/170 |
| D503,629 | S | | 4/2005 | Rabassa | |
| 6,945,426 | B2 | * | 9/2005 | Gentzkow et al. | 220/751 |
| D515,944 | S | | 2/2006 | Ohki | |
| D520,381 | S | | 5/2006 | Vigneron | |
| D520,382 | S | | 5/2006 | Vigneron | |
| 7,196,972 | B2 | * | 3/2007 | Pitocco et al. | 368/10 |
| 7,237,703 | B1 | * | 7/2007 | Nathan et al. | 224/148.5 |
| 7,316,332 | B2 | * | 1/2008 | Powers et al. | 222/175 |
| 7,542,379 | B2 | * | 6/2009 | Kimel et al. | 368/10 |
| 7,735,682 | B1 | * | 6/2010 | Cassel et al. | 221/185 |
| 7,766,193 | B2 | * | 8/2010 | Stollmann et al. | 222/175 |
| D637,094 | S | | 5/2011 | Cobbett et al. | |
| D640,367 | S | | 6/2011 | Lin et al. | |
| 8,739,795 | B2 | | 6/2014 | Kanowitz | |
| 8,950,632 | B2 | | 2/2015 | Ciavarella | |
| 2001/0042758 | A1 | | 11/2001 | DiTomasso et al. | |
| 2004/0016774 | A1 | * | 1/2004 | Gentzkow et al. | 222/175 |
| 2006/0243765 | A1 | * | 11/2006 | Valeriana | 224/148.2 |
| 2007/0289160 | A1 | * | 12/2007 | Hansen | 36/1 |
| 2008/0035653 | A1 | * | 2/2008 | Meli | 220/717 |
| 2008/0067193 | A1 | | 3/2008 | Powers | |

FOREIGN PATENT DOCUMENTS

| | | | |
|---|---|---|---|
| WO | 00/16657 | A1 | 3/2000 |
| WO | WO2005092144 | | 10/2005 |
| WO | 2009/080845 | A1 | 7/2009 |

OTHER PUBLICATIONS

International Preliminary Report of Patentability from related PCT/GB2007/000169, issued Jul. 22, 2008.

Search Report for related GB Patent Application No. 1312711.3, mailed on Jan. 14, 2015, in 1 page.

Office Action for related U.S. Appl. No. 29/450,807, mailed on Apr. 2, 2015, in 7 pages.

International Search Report for related PCT Patent Application No. PCT/GB2014/052172, mailed on Nov. 3, 2014, in 4 pages.

* cited by examiner

DIABETIC DISPENSER

The present invention relates a dispenser intended for diabetic users, which can store a quantity of glucose or a similar sugary product and allow rapid access to the product in the event of the onset of a 'Hypo' or hypoglycemic symptoms.

Diabetes currently affects approximately 1.8 million people in the UK, equivalent to three percent of the UK population, and it is estimated that this percentage will continue to increase due to an aging population and increased prevalence of obesity.

Diabetics often experience hypoglycemia, commonly referred to as a 'Hypo', where their blood glucose level falls too low. Hypos are often caused by stress, delayed meals, insufficient carbohydrate intake or periods of extended exercise, and can occur unexpectedly and quickly, coming on within minutes. Common symptoms include sweating, ravenous hunger, trembling, headaches, behavioural changes, rapid heart beat, weakness, drowsiness and confusion, and if left untreated can lead to unconsciousness.

As such, Hypo's can be extremely problematic for diabetics. Treatment of a Hypo requires the diabetic to stop what they are doing and take some sugars, which will be absorbed quickly, in order to raise their blood glucose level. Typically, a diabetic might take a sugary sports drink upon the onset of symptoms of a Hypo. However, the speed at which the symptoms subside is dependant on how quickly these sugars can be absorbed. More recently, tubes of glucose gel have been marketed for the treatment of Hypos. These gels offer a considerable advantage over more conventional foods and drinks as they provide a glucose dense medium that can be absorbed extremely quickly.

The widespread availability of sugar rich foods and drinks, as well as Hypo specific glucose gels, has greatly improved how diabetics deal with Hypos during their everyday lives. That said, there is still a necessity for diabetics to have suitable foods or drinks readily available throughout the day. Whilst this may not be difficult for a person, for example, to keep a pack of sweets in their desk drawer at work, it can cause problems during other activities. For example, a diabetic performing sporting or other physical activities, and particularly outdoor activities such as water sports, running or skiing, may find it difficult or inconvenient to store sugar rich foods. A further example would be an older person with diabetes whose mobility may be impaired or a diabetic who suffers particularly intense symptoms. The onset of a Hypo may be traumatic for such a person as they may find it very difficult to get to or open the packaging to a sugar rich food or drink.

U.S. Pat. No. 4,078,660 discloses a wristband for a diabetic carrying a "medicine". The band must be ruptured to remove it before the medicine is dispensed, making it unsuitable for self-operation by a person starting to feel the onset of a Hypo.

It is therefore an object of the present invention to overcome such problems.

According to a first aspect of the present invention there is provided a dispenser bracelet wearable on the wrist or arm and for carrying a consumable product for the treatment of the symptoms of hypoglycemia of a diabetic user, the dispenser bracelet comprising: a bracelet body having one or more sealed receptacles for containing said consumable product; one or more access portions provided on a surface of the bracelet body and through which access to the consumable product; and a bite area associated with each of the one or more access portions having a frangible seal for sealing said teats, said seal being frangible by the user biting the bite area for allowing the consumable product to be readily accessed through the one or more access portions by the user's mouth.

In this way, the present invention allows a user easy access to a consumable product in order to treat the symptoms of hypoglycemia. Furthermore, the consumable product can be readily available throughout the day and, for example, can be immediately accessed upon the onset of symptoms of a Hypo.

The present invention, using a concentrated source such as, very preferably, glucose gel, can be both lightweight and small in size since only around 20-25 grams (at minimum, 15 g) of gel are required. Thus, the dispenser can be worn at any or all times, making it suitable as an emergency self-administration device. Very preferably, multiple teats or nozzles are radially disposed around the wrist so that the user can readily find one without needing to rotate the arm or use the other arm to rotate the wristband, thus enabling the device to be used even if the user has collapsed.

Various superficially similar proposals are known in the art. US 2004/0016774 discloses a wrist lanyard carrying a sachet of medicine which is ruptured with the teeth. This would be unsuitable for self-operation by a person starting to feel the onset of a Hypo since, if weak, the freely-swinging sachet could easily be accidentally ruptured whereas, if strong, the sachet could not be ruptured by a person starting to feel the onset of a Hypo. Large, heavy constructions which serve not only as drinks reservoirs but also as weight training devices are disclosed in U.S. Pat. No. 4,736,876, WO 99/48405 and US 2001/0042758. However, if heavy enough to be used for weight training, these are clearly unsuitable for constant wear by a diabetic, as being simply too heavy. Of similarly heavy construction are U.S. Pat. No. 5,957,347, WO 2005/092144. U.S. Pat. No. 6,173,866 discloses a similar arrangement, but one which would require a VELCRO™, hook-and-loop fabric, securing band to be undone for use, making it unsuitable for self-operation by a person starting to feel the onset of a Hypo.

Preferably, the one or more access portions comprise one or more teats raisable above the general surface of the bracelet body and configured to fit inside the user's mouth. In this way, the consumable product can be easily dispensed into the user's mouth.

Preferably, the one or more receptacles are conformable to the shape of the dispenser bracelet when said dispenser bracelet is fitted to the wrist or arm of the user. In this way, the dispenser band has a low profile on the user's wrist such that it is not bulky and can be comfortably worn by the user.

Preferably, each access portion is associated with one of the one or more receptacles. In this way, the contents of each receptacle can be accessed separately. Therefore, each receptacle can, for example, contain a predetermined quantity or dosage of the consumable product, allowing a single dosage to be accessed easily.

Preferably, there is provided an elasticated portion for resiliently retaining the bracelet body in position on the user's wrist or arm. In this way, the dispenser band can be resiliently retained in the desired position.

Preferably, there is provided fastener means for securing the bracelet body on the user's wrist or arm. Accordingly, the dispenser band can be securely attached to the user's wrist or arm at a desired position or tightness.

Preferably, the fastener means comprises at least one selected from a group consisting of a fastener, a clip, a buckle, a button, and VELCRO™, hook-and-loop fabric.

Preferably, the access portion comprises at least one selected from a group consisting of a foldable closure, a nozzle, an aperture, a closable cap, and a one way teat.

Preferably, the one or more receptacles are resistant to compression for preventing undue pressure being placed on their contents. In this way, undue leakage of consumable product is reduced or prevented.

Preferably, the bracelet body is formed of a transparent material. In this way, can be worn discretely without drawing undue attention to the user.

According to a further aspect of the present invention there is provided a dispenser bracelet wearable on the wrist or arm and for carrying a consumable product for the treatment of the symptoms of hypoglycemia of a diabetic user, the dispenser bracelet comprising: a bracelet body having one or more sealed receptacles for containing said consumable product, wherein the one or more receptacles are blister pack type receptacles formed on the bracelet body; one or more access portions provided on a surface of the bracelet body and through which the consumable product contained in the blister pack type receptacles can be extracted; and a bite area associated with each of the one or more access portions, wherein each of said one or more access portions has a frangible seal, said seal being frangible by the user biting the bite area for allowing the contents of the blister pack type receptacles to be readily accessed by the user's mouth.

Examples of the present invention will now be described with reference to the accompanying drawings in which.

Figure 1:
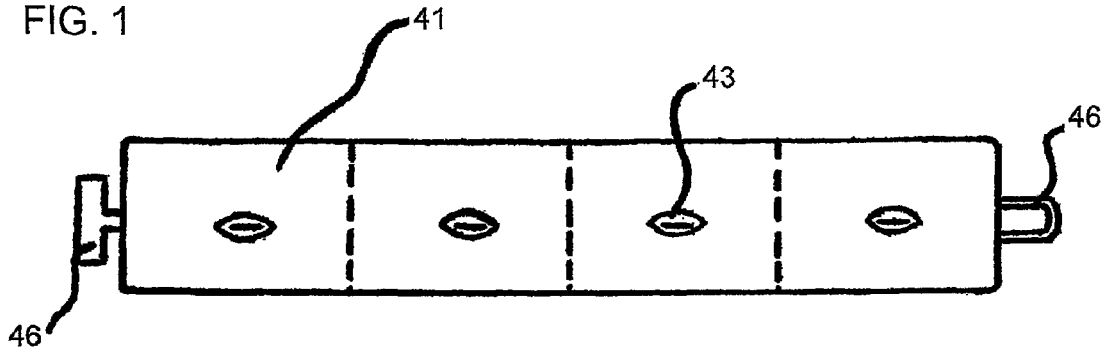
FIG. 1 shows a top view of a dispensing band according to a first embodiment of the present invention in an open position.
Figure 2:
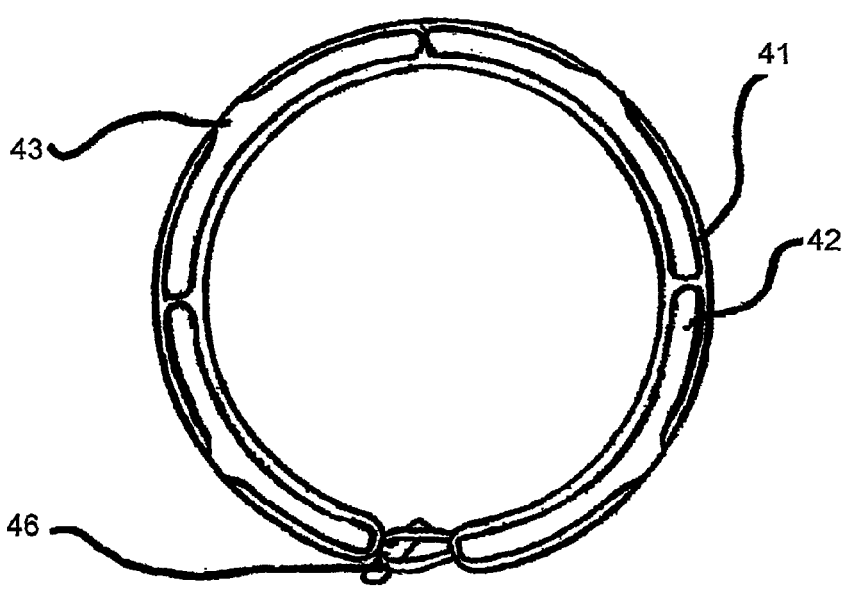
FIG. 2 shows a cross-sectional representation of the dispensing band of FIG. 1 in a closed position as it would be if attached to a user's wrist.

FIGS. 1 and 2 show a first embodiment of the present invention. In this embodiment, four receptacles 42 are formed integrally into a bracelet-like band 41, the receptacles 42 each containing a sugary consumable product. A fastener 46 is provided to allow the two ends of band 41 to be attached together around a user's wrist or arm. Each receptacle 42 has a one way teat 43 provided on the peripheral surface of the band 41. The teats 43 allow a user to consume the consumable product contained in the receptacles 42 by sucking it out when desired. The sucking action is required in order to enable passage of the consumable product through the teat 43, thereby preventing unwanted leakage of the product. In addition, external substances are prevented from entering receptacles 42 by the one way valve teats 43, thereby sealing and preserving the consumable product within the receptacle until it is required. Preferably, the band 41 is resistant to compression for resisting pressure being placed on the contents of the receptacles 42. Such internal pressure could otherwise effectively force the consumable product contained in the receptacles 42 to breach of the seal of the one way teats 43, and unduly leak out.

Figure 3:
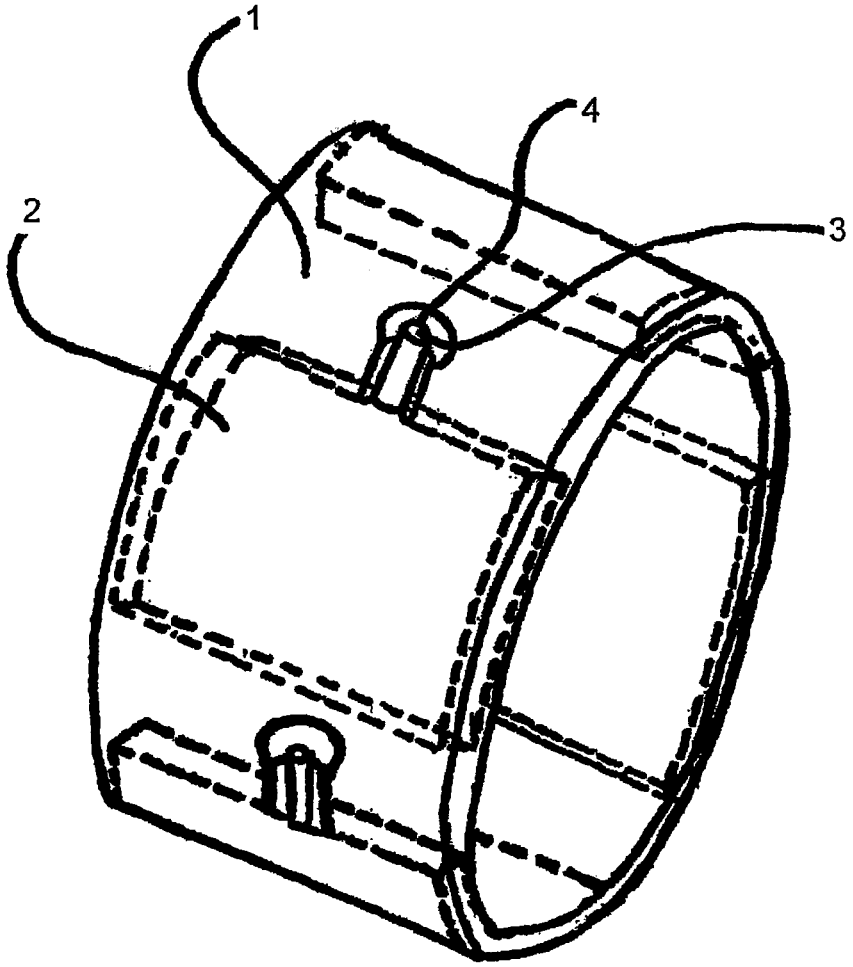
FIG. 3 shows a dispensing band according to a second embodiment of the present invention.

FIG. 3 shows a dispensing band according to a second embodiment of the present invention. The dispensing band can be fitted around a user's wrist, or alternatively higher up their arm, and is secured in place by the band 1.

Within the body of band 1 there are provided a plurality of sealed receptacles 2. In this embodiment, four receptacles are provided, however it is also envisaged that a single receptacle or any other practical number of receptacles could alternatively be provided. The receptacles 2 contain a consumable product and preferably a sugary substance, for example a glucose gel or liquid.

A nozzle or teat 3 is provided through which a user can access the contents of the receptacle 2. The teat 3 is inset into indent 4 in an unopen position, where it is partially enclosed and protected within the band 1. In this way, the teat 3 does not protrude substantially from the profile of the band 1 thereby avoiding it catching on clothing and other items which the user might contact with when wearing the dispenser band.

Figure 4:
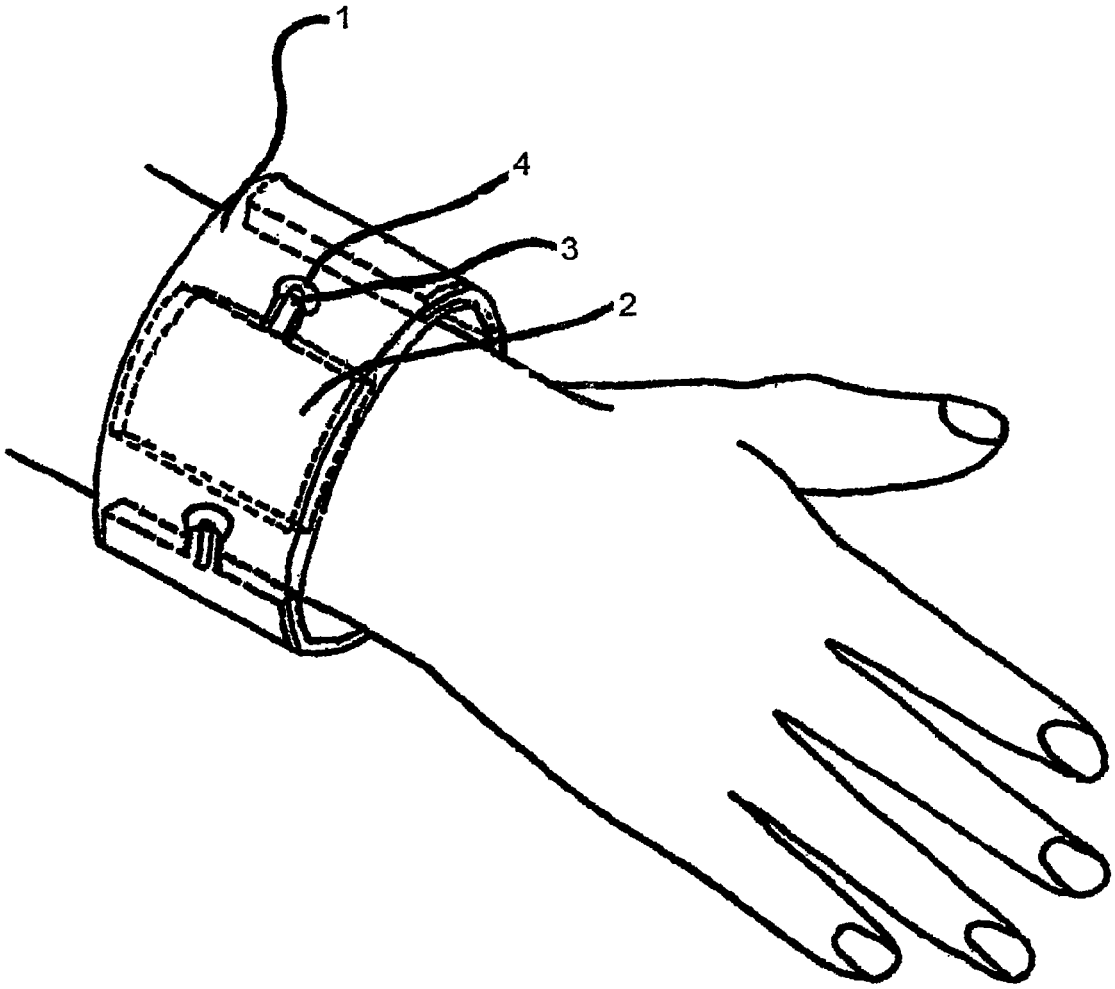
FIG. 4 shows the dispenser band of FIG. 3 when fitted to a user's wrist.

FIG. 4 shows the dispenser band of FIG. 3 when fitted to a user's wrist. The user can wear the dispenser band in much the same way as they would a watch or bracelet.

The band 1 forms a complete loop through which the user can feed their hand so that the band surrounds the wrist. The band is preferably made of a fabric or plastics material, or a combination of both. In this embodiment, the band 1 includes one or more elasticated portions (not shown) disposed between the receptacles 2. These elasticated portions enable the band 1 to be easily stretched over the user's hand and allow the dispenser band to be resiliently held in position on a user's wrist, thereby limiting unnecessary movement of the dispenser band when the user moves.

In other embodiments, the dispenser band can also be provided with a buckle, clip, VELCRO™, hook-and-loop fabric, strap, or other fastener; instead of, or in addition to, the elasticated portions. In this way, the dispenser band maybe fastened to the user's wrist at the desired tightness and in the desired position.

As the dispenser band wraps around a user's wrist or arm, its overall shape generally conforms to the shape of the wrist or arm such that the band 1 (and hence the receptacles 2) presents a low profile on the user's wrist or arm. In this way, the dispenser band can be worn comfortably, in much the same way as a wrist watch or bracelet.

Each of the receptacles 2 contains a consumable product in the form of a quantity of a sugary substance, for example a glucose gel, liquid, or solid granules exhibiting fluid like qualities. The advantage of a highly dense glucose source, such as a glucose gel, is that relatively small amounts are required for the treatment of a hypo. For example, the dispenser band may only need to contain 20 to 25 g of glucose gel (at least 15 g) for the treatment of a hypo, allowing the overall size and weight of the dispenser band to be minimised so that the band needn't be cumbersome or heavy, and may be a similar size and weight to a wrist watch.

A further advantage of using a gel or viscous liquid is that such a substance is less likely to leak or spill during use.

When the user feels that they are having, or are about to have, a hypo they can bring the dispenser band secured on their wrist or arm to their mouth easily. Each of the four receptacles 2 has a teat 3 which are distributed around the band 1. Advantageously, this allows the user quick access to the glucose substance whatever orientation the band 1 is at, as they can access whichever of the receptacles 2 is closest to their mouth. In this connection, since the band 1 is held securely in position by the elasticated portions and/or a fastener, a user can easily locate the teat 3 at their mouth. The teat 3 itself is retained within indent 4, and when a user wishes to consume the substance, they can pull the teat 3 outward so that it protrudes from the periphery of the band 1. Preferably, this can be done by the user's mouth, however a user may also use their free hand to pull out the teat 3. The action of pulling out the teat acts to open the receptacle 2. Alternatively, a closure with a frangible seal may be provided, which can be is broken to open the teat 3.

Accordingly, upon the onset of hypo symptoms, a user can quickly access the sugary consumable product within the dispenser band. Since the dispenser band is relatively small and can conveniently be worn at all times, it is particularly advantageous in that it allows a diabetic easy access a source of glucose as and when it is required, even when playing sport or outdoors. Moreover, since the dispenser band retains the substance in a sealed receptacle 2, participants of water sports, such as swimmers or surfers could wear the band, even in the water.

Figure 5:
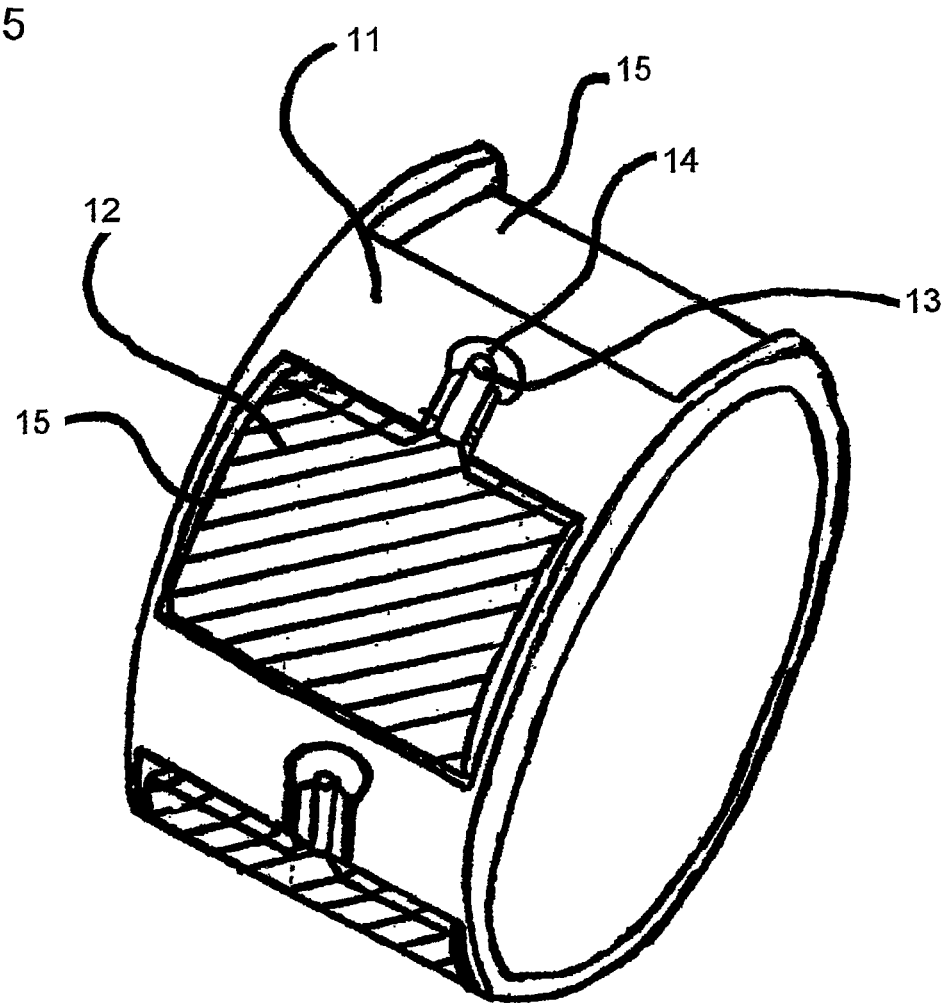
FIG. 5 shows a dispensing band according to a third embodiment of the present invention.

FIG. 5 shows a third embodiment of the present invention. Similar to that described above with reference to FIGS. 3 and 4, this embodiment includes a band 11 wearable by a user on their wrist. In this embodiment however, the receptacles 12 are disposable cartridges which can be detachably fitted to the band 11. In this connection, band is provided with one or more docking stations 15 into which the receptacles 12 can be fitted. The receptacles 12 are retained within the docking stations 15 by clips or another suitable securing means (not shown). Advantageously, by providing the receptacles 12 in the form of disposable cartridges, the receptacles 12 can be replaced once the consumable product contained inside them has been consumed. This is particularly advantageous in that when the contents of one receptacle is consumed it can be replaced, without wasting the contents of the remaining receptacles 12 that are still full.

Figure 6:
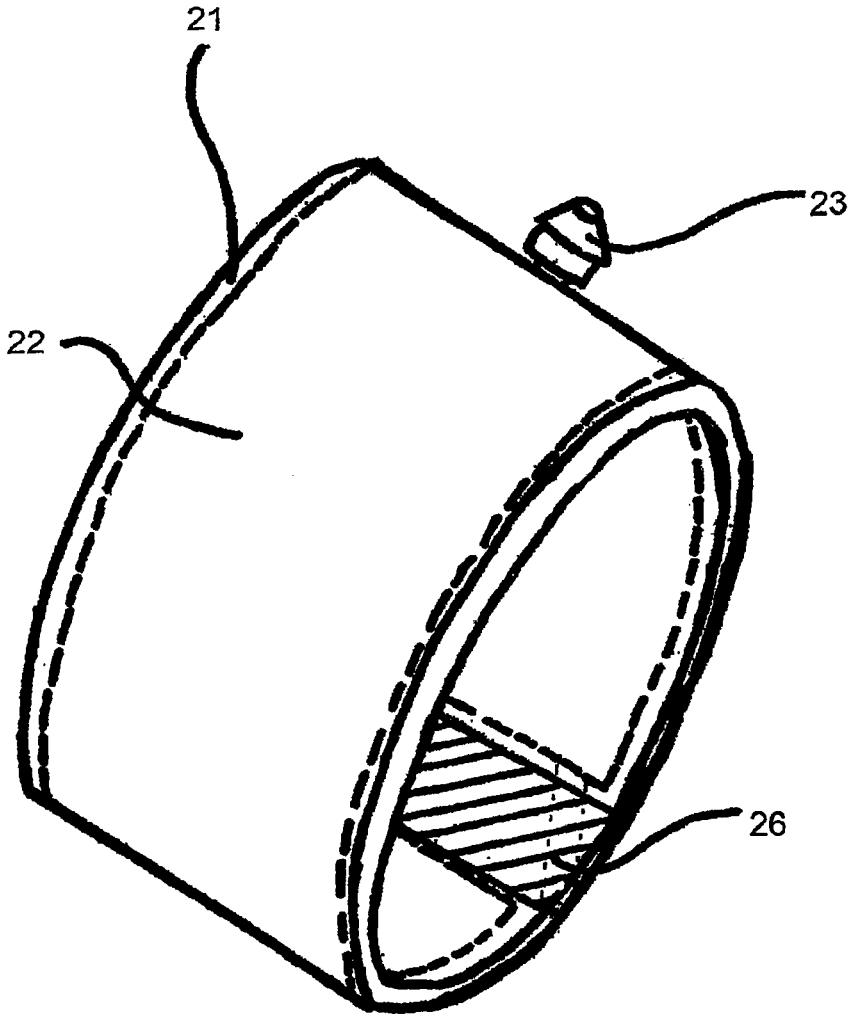
FIG. 6 shows a dispensing band according to a fourth embodiment of the present invention.

FIG. 6 shows a fourth embodiment of the present invention. In this embodiment, a single receptacle 22 is formed integrally into band 21. An elastic section 26 is provided in the band 21 and enables the band 1 to be resiliently retained on a user's wrist. Sports closure 23 is provided on the band 21 and forms a closable teat through which the contents of receptacle 22 can be consumed. A relatively large storage capacity in the receptacle 22 may be provided so that the dispenser band according to this embodiment is suitable not only for the treatment of Hypos, but also for general sporting or physical activities. For example, the dispenser band may contain a isotonic sports drink. In this case, this embodiment may be particularly suitable for long distance runners, for example, who require regular fluids but find the carrying of a drinks bottle whilst running inconvenient.

Figure 7:
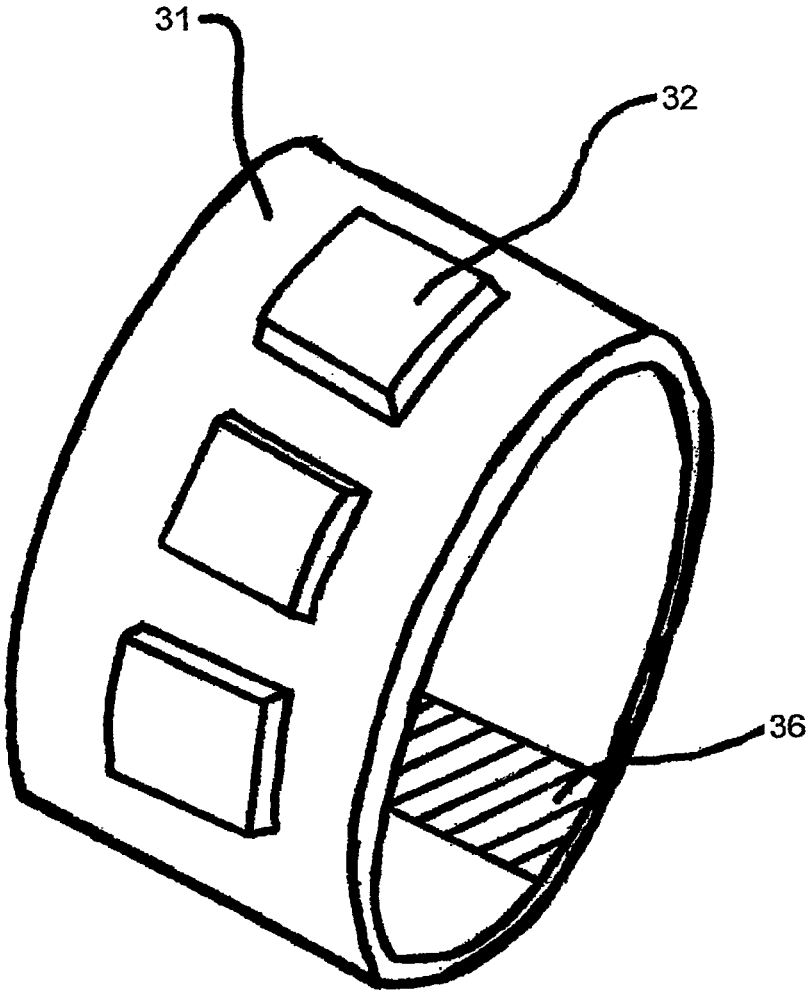
FIG. 7 shows a dispensing band according to a fifth embodiment of the present invention.

FIG. 7 shows a fifth embodiment of the present invention. In this embodiment, the band 31 is provided with a number of blister pack type receptacles 32. Each blister receptacles 32 may contain a hard sweet which is held in place by a frangible cover. The hard sweet can be broken out from the frangible cover by applying pressure to the sides of the receptacle 32, for example by a user biting the sides of the receptacle 32. Preferably, the hard sweet is shaped to facilitate the breaking of the frangible cover when pressure is applied.

Figure 8:
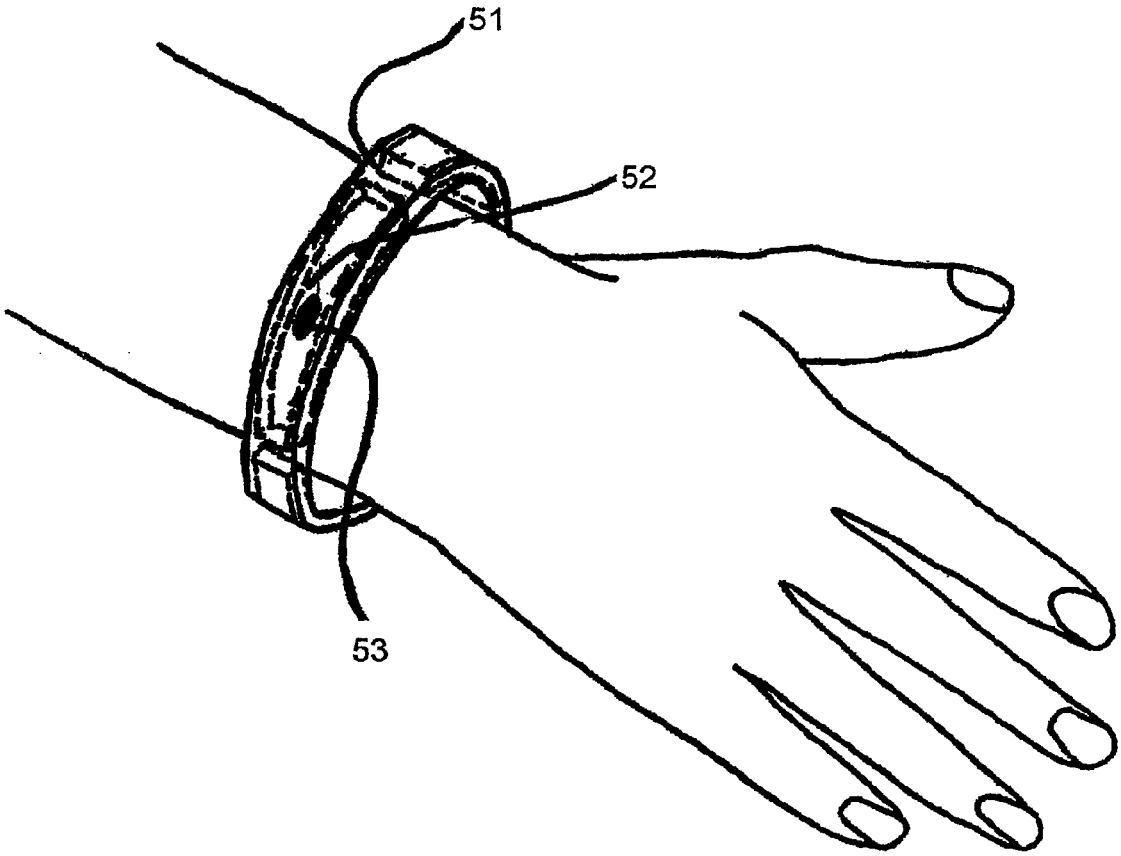
FIG. 8 shows a dispensing band according to a sixth embodiment of the present invention.

FIG. 8 shows a sixth embodiment of the present invention. In this embodiment, four receptacles 52 are formed integrally into a bracelet-like band 51, the receptacles 52 each contain a sugary consumable product. The band includes a fastener (not shown) to allow the band 51 to be attached around a user's wrist or arm. Each receptacle 52 has a teat 53 or nozzle, provided on the peripheral surface of the band 51, through which a user can consume the consumable product contained in the receptacles 52. The teat 53 may be a one way valve teat, as discussed above in reference to the first embodiment of the present invention, or any other suitable teat or nozzle. For example, the teat 53 may comprise a nozzle aperture covered by a frangible seal, wherein a user can break or bite off the frangible seal to open the nozzle aperture and get access to the consumable product.

With the sixth embodiment of the present invention, the band 51 is thinner than those illustrated in previous embodiments. Accordingly, the storage capacity of receptacles 52 is relatively smaller. As discussed above, the amount of storage capacity required is dependant upon the intended function and requirements of the dispenser band. In this embodiment, the dispenser hand is specifically designed for diabetic users who only require enough consumable product in order to treat the symptoms of hypoglycemia. Accordingly, a glucose gel, which is a highly dense glucose source, is provided within each of the receptacles 52, and the total storage capacity of the band 51 may be only 20 to 25 g of glucose gel. Therefore, the band 51 is thin and light, and subsequently can be worn discretely without drawing undue attention to the user.

A further feature of the sixth embodiment is that the band 51 can be made of a clear transparent plastics material. Since the glucose gel stored within the receptacles 52 can also be clear, the overall appearance of the dispenser band is substantially transparent, thereby further concealing the dispenser band and allowing it to be worn discretely without drawing undue attention to the user. Alternatively, the band 51 could be made of another colour material. For example, a black colour band may be provided to give a purposeful look, similar to a diver's wrist watch. Whilst such a colour may not conceal the band 51, it does not look out of place on a user's wrist. A further example would be different brightly coloured bands, such as red or blue, intended for children.

It is also envisaged that the band may be configured to allow the dispenser band to be fitted outside of a user's clothing around their wrist or arm. For example, a user may want to wear the dispenser band on the outside of a ski jacket or a wet suit. Accordingly, a larger band could be provided, or the band could be configured to have a variable fastener or large elastic portion, thereby allowing it to be fitted outside of a user's clothing.

Figure 9:
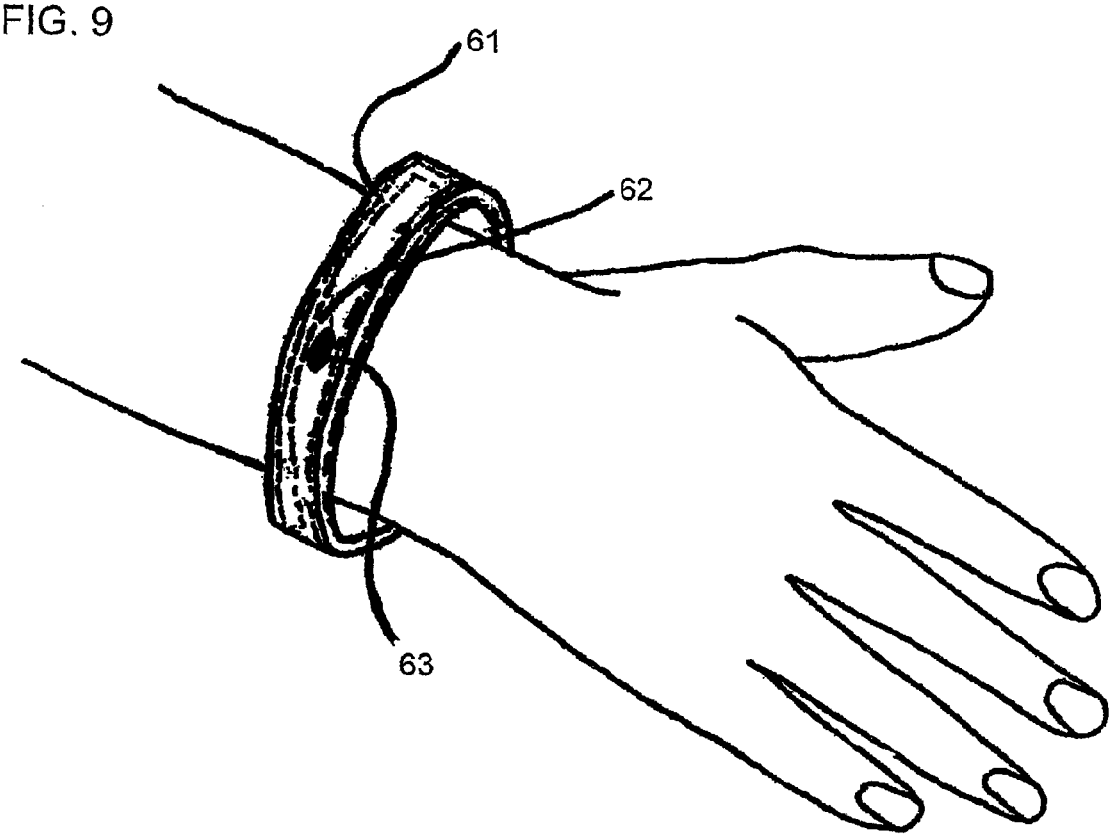
FIG. 9 shows a dispensing band according to a seventh embodiment of the present invention.
Figure 10:
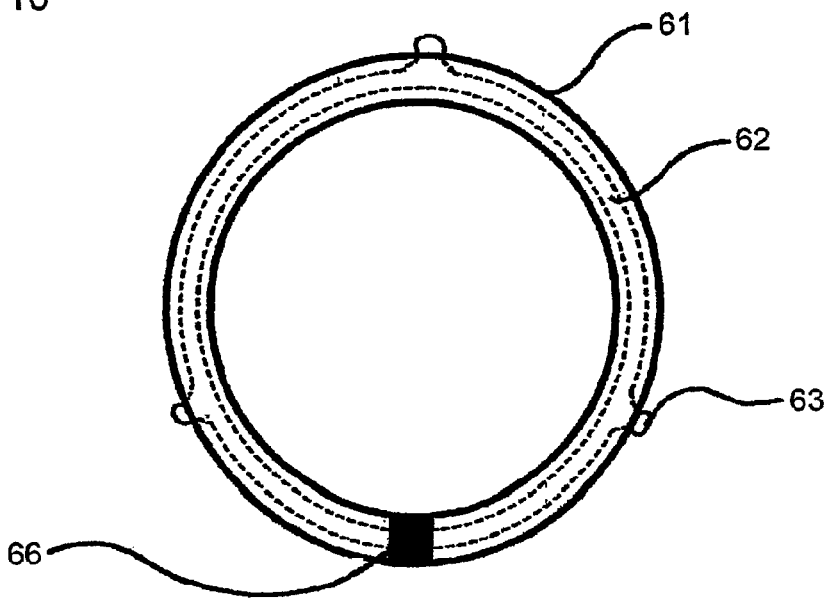
FIG. 10 shows a cross-sectional representation of the dispensing band of FIG. 9.

FIGS. 9 and 10 show a seventh embodiment of the present invention. The individual features are similar to those disclosed in the previous embodiment, however, in this case a single receptacle 62 is provided inside the bracelet 61 with three teats 53 or nozzles providing access thereto. As with previous embodiments, a clip fastener 66 is provided to allow the bracelet 61 to be attached around a user's wrist. Each of the three teats 53 includes a frangible seal.

On the onset of a hypo reaction, a user can place his mouth around one of the teats 63, over a so-called bite area, and bite down so as to break the frangible seal provided on the teat 63. The user can then suck out the contents of the receptacle 62 in order to treat his symptoms.

The provision of three teats 63 allows the user easy access to the receptacle whichever orientation the bracelet 61 is in. Accordingly, even if the bracelet were to be rotated around a user's wrist, they would still be able to reach one of the teats easily. Furthermore, the use of a single receptacle allows the bracelet to be small and thin, since the quantity required to treat the hypo symptoms is contained in a single reservoir which can be accessed from any of the three teats 63, rather than multiple separate reservoirs each having their own teat. This allows a user to wear the bracelet discreetly, without drawing attention to his condition. Once the contents of the receptacle has been consumed, it can be thrown away and replaced. Although in this example three teats have been shown, two or more teats could alternatively be used.

Figure 11:
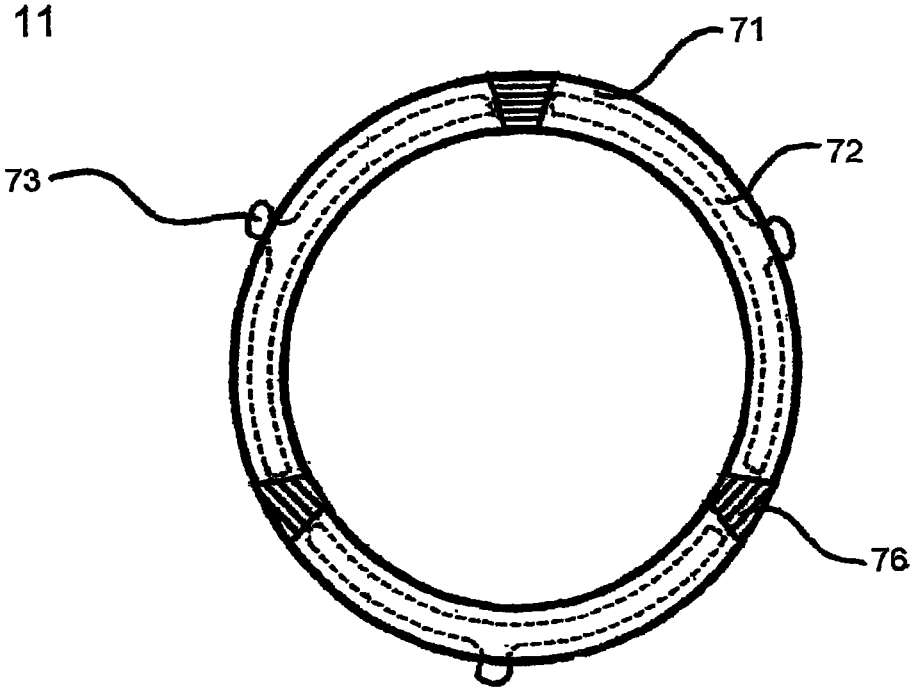
FIG. 11 shows a cross-sectional representation of a dispensing band according to an eighth embodiment of the present invention.
Figure 12:
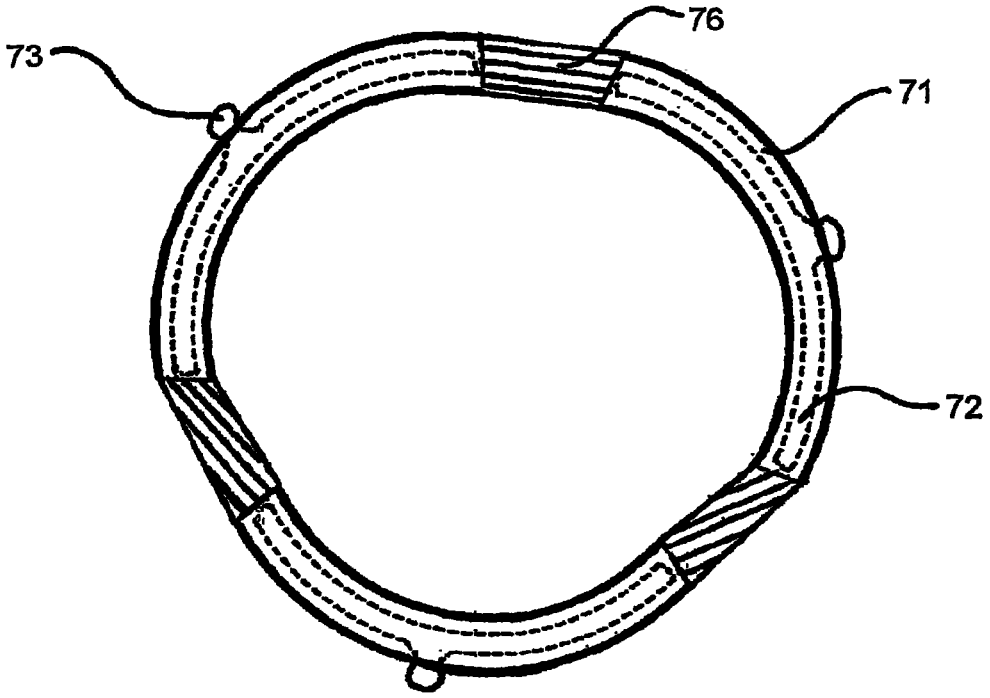
FIG. 12 shows a cross-sectional representation of the dispensing band of FIG. 11 in an expanded position.

FIGS. 11 and 12 show an eighth embodiment of the present invention. In this example, the bracelet is divided into three separate sections 71, linked by elastic portions 76. Each section 71 is rigid and has an arced shape, so that the bracelet sections 71 conform to the shape of a users wrist. The elastic portions 76 allow the bracelet to be stretched over a users hand so that it can be placed around the wrist.

Each of the rigid sections 71 contains a receptacle 73 containing sugary fluid for treating a hypo, along with a teat 73 for gaining access thereto. As with previous embodiments, a frangible seal is provided to seal the teats until the contents of the receptacle is required by the user.

In this embodiment, the use of rigid sections allows the bracelet to be tough and durable, so that a user can wear the bracelet throughout the day and night. It also prevents the contents of the receptacle being released if, for example, the bracelet is sat on or otherwise undesirably compressed. Furthermore, due to the relatively small quantities of fluid required to treat a hypo, the use of a rigid receptacle does not affect the user's ability to access the fluid, since the small volume inside the receptacle allows the user to easily suck out its contents.

In this example, three sections are used, however any plurality of sections could be used. For example, two or more.

Other embodiments of the present invention are also envisaged. For example, the dispenser band may form part of a watch strap or include a watch, such that the band serves a dual purpose as a wrist watch and a dispenser.

In another envisaged embodiment, a sheath or cover is provided over the teats so keep them clean. Each sheath or cover can be easily pulled or torn off by a user prior to biting into the teat so as to avoid infecting the user.

Accordingly, the present invention allows a user easy access to a consumable product for treating their symptoms of a hypo reaction. In this way, the consumable product can be readily available throughout the day and can be immediately accessed upon the onset of symptoms of a Hypo.

It will be understood that the illustrated embodiments described herein show an application of the invention only for the purposes of illustration. In practice the invention may be applied to many different configurations; the detailed embodiments being straightforward to those skilled in the art to implement.

For example, the consumable product could take the form of a medicine for use treating disease or alleviating pain, or an antihistamine for dealing with over zealous allergic reactions.

In another example, instead of using teats or nozzles, alternative access portions for gaining access to the receptacles may be provided. For examples, one or more access portions can be formed of thinner material on the main body of the bracelet. In this way, the access portion provides a frangible seal which can be broken in order to gain access to the contents of the receptacle. Furthermore, these access portions may be marked or coloured to indicate where a user should bite and suck in order to break the frangible seal and gain access to the contents of the receptacle.

The invention claimed is:

1. A dispenser bracelet wearable on the wrist or arm carrying a consumable product for the treatment of the symptoms of hypoglycemia of a diabetic user, the dispenser bracelet comprising:

a bracelet body having a band including a fastener for attaching two ends of the band together, and one or more sealed receptacles including a cartridge fitted to the band and containing said consumable product, the consumable product comprising a glucose gel, each sealed receptacle also including an access portion allowing access to the consumable product; and, the access portion including an aperture, and a nozzle extending from the cartridge and partially enclosed in the band, the nozzle including a frangible seal covering the aperture, said frangible seal being breakable by the user biting the frangible seal area for allowing the consumable product to be readily accessed through the access portion by the user's mouth.

2. A dispenser bracelet according to claim 1, wherein a plurality of said access portions are provided, distributed in use approximately radially evenly around the wrist.

3. A dispenser bracelet according to claim 1, wherein the one or more access portions comprise one or more teats raisable above the general surface of the bracelet body and configured to fit inside the user's mouth.

4. A dispenser bracelet according to claim 1, wherein said one or more receptacles are conformable to the shape of the dispenser bracelet when said dispenser bracelet is fitted to the wrist or arm of the user.

5. A dispenser bracelet according to claim 1, wherein each access portion is associated with one of the one or more receptacles.

6. A dispenser bracelet according to claim 1, further comprising an elasticated portion for resiliently retaining the bracelet body in position on the user's wrist or arm.

7. A dispenser bracelet according to claim 1, further comprising fastener means for securing the bracelet body on the user's wrist or arm.

8. A dispenser bracelet according to claim 7, wherein the fastener means comprises at least one selected from a group consisting of a fastener, a clip, a buckle, a button, and a hook-and-loop fabric.

9. A dispenser bracelet according to claim 1, wherein the or each access portion comprises at least one selected from a group consisting of a foldable closure, a nozzle, an aperture, a closable cap, and a one way teat.

10. A dispenser bracelet according to claim 1, wherein the one or more receptacles are resistant to compression for preventing undue pressure being placed on their contents.

11. A dispenser bracelet according to claim 1, wherein the bracelet body is formed of a transparent material.

12. A method of self-administration of a glucose gel by a diabetic comprising locating an access portion of a wristband carried by said diabetic, the wristband including a band, a sealed receptacle fitted to the band, an aperture in the receptacle, and the access portion including a frangible seal covering the aperture, said sealed receptacle containing at least 15 grams of said gel, breaking the frangible seal, and drinking said glucose gel from said access portion.

13. A dispenser bracelet wearable on the wrist or arm carrying a consumable product for the treatment of the symptoms of hypoglycemia of a diabetic user, the dispenser bracelet comprising:

a sealed receptacle including a cartridge containing the consumable product, the consumable product comprising a glucose gel, an aperture in the cartridge for accessing the consumable product, and a nozzle including a frangible seal covering the aperture, the frangible seal being breakable by a user to get access to the consumable product; and a band including one or more docking stations into which the cartridge is fitted, an indent adjacent one of the one or more docking stations that partially encloses the nozzle, and a buckle fastener for attaching two ends of the band together.

* * * * *